United States Patent [19]

Sze et al.

[11] 3,954,595

[45] May 4, 1976

[54] COAL LIQUEFACTION

[75] Inventors: Morgan C. Sze, Upper Montclair; George J. Snell, Fords, both of N.J.

[73] Assignee: The Lummus Company, Bloomfield, N.J.

[22] Filed: Mar. 18, 1974

[21] Appl. No.: 452,409

[52] U.S. Cl. ..... 208/8; 208/10

[51] Int. Cl.[2] ..... C10G 1/04

[58] Field of Search ..... 208/8, 10

[56] References Cited

UNITED STATES PATENTS

| | | | |
|---|---|---|---|
| 3,018,241 | 1/1962 | Gorin | 208/8 |
| 3,162,594 | 12/1964 | Gorin | 208/8 |
| 3,375,188 | 3/1968 | Bloomer | 208/8 |
| 3,687,837 | 8/1972 | Fiocco et al. | 208/8 |
| 3,790,467 | 2/1974 | Fiocco et al. | 208/8 |
| 3,791,956 | 2/1974 | Gorin et al. | 208/10 |
| 3,808,119 | 4/1974 | Bull et al. | 208/8 |
| 3,852,182 | 12/1974 | Sze et al. | 208/8 |
| 3,852,183 | 12/1974 | Snell | 208/8 |
| 3,856,675 | 12/1974 | Sze et al. | 208/8 |

*Primary Examiner*—Delbert E. Gantz
*Assistant Examiner*—James W. Hellwege
*Attorney, Agent, or Firm*—Marn & Jangarathis

[57] ABSTRACT

Insoluble material is separated from a coal liquefaction product by gravity settling in the presence of a specified promoter liquid. The settling is effected to recover a net underflow having a specified ash content and the underflow is stripped of valuable products. By controlling the ash content of the underflow, loss of valuable product in the underflow can be minimized.

13 Claims, 1 Drawing Figure

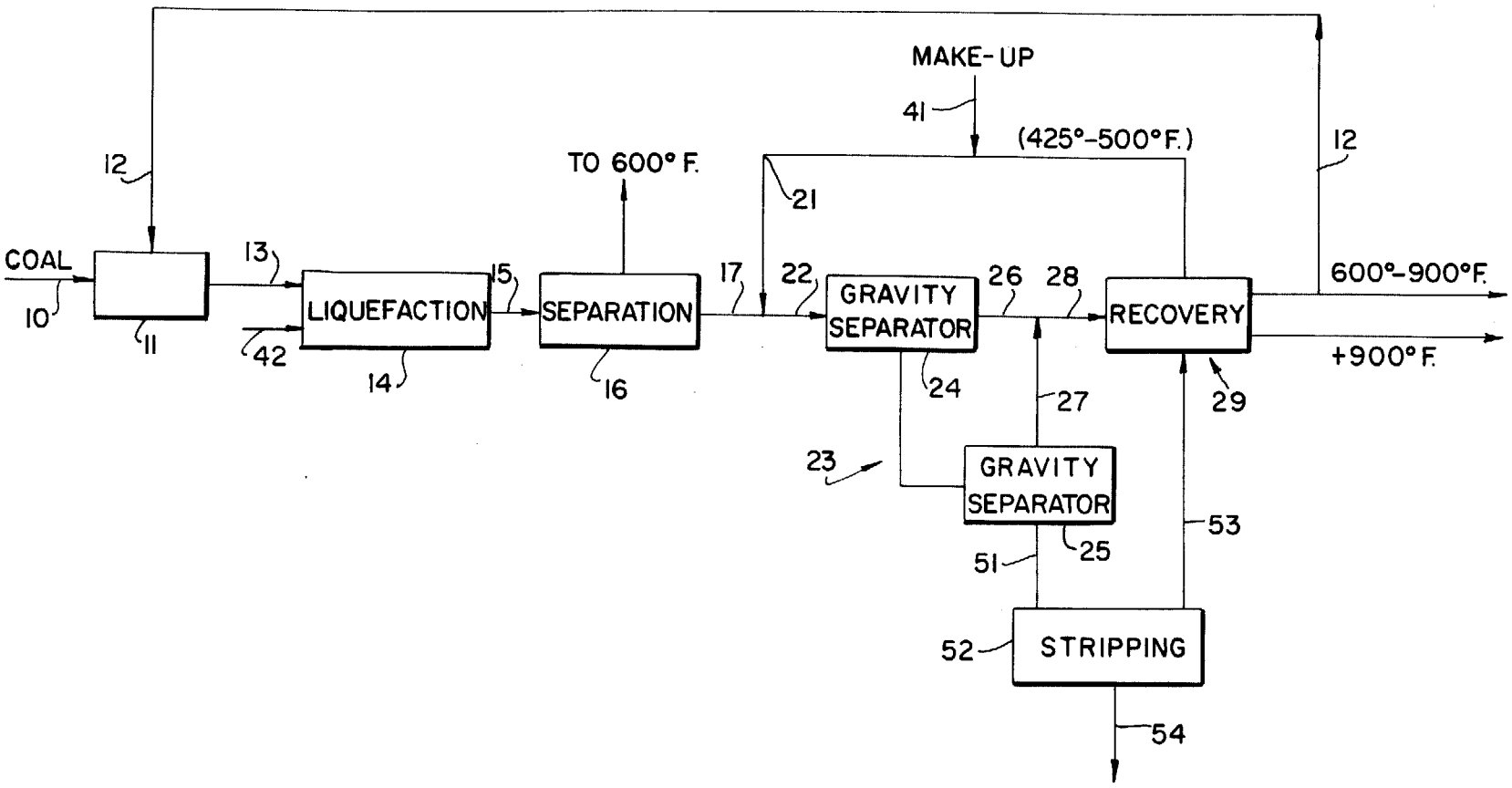
COAL
10
11
12
13
42
LIQUEFACTION
14
15
SEPARATION
16
TO 600° F.
17
21
22
GRAVITY SEPARATOR
24
23
26
28
27
GRAVITY SEPARATOR
25
51
STRIPPING
52
54
53
RECOVERY
29
(425°-500°F.)
MAKE-UP
41
12
600°-900°F.
+900°F.

COAL LIQUEFACTION

This invention relates to the liquefaction of coal, and more particularly, to the deashing of a coal liquefaction product.

Coal can be converted to valuable products by subjecting coal to solvent extraction, with or without hydrogen, to produce a mixture of coal extract and undissolved coal residue, including undissolved extractable carbonaceous matter, fusain and mineral matter or ash.

The finely divided mineral matter or ash and unreacted coal must be separated from the coal extract, and in general, this separation step has been the principal draw-back to the successful operation of a coal extraction process. The fine particle sizes encountered in coal solvation processes create numerous difficulties in attempting to use conventional separation techniques, such as filtration, centrifugation, or settling. Attempts to use filtration techniques have not been particularly successful as a result of plugging of the filter pores with or without a precoat and the expense involved in providing the required filtration area.

Gravity settling techniques have also met with limited success as a result of low settling rates and inefficient ash removal. Centrifugation techniques have also been generally unsuccessful as a result of high cost and the difficulty in separating the lighter finely divided materials.

Accordingly, there is a need for an effective process for separating finely divided insoluble material from a coal liquefaction product.

An object of the present invention is to provide for improved coal liquefaction.

Another object of the present invention is to provide a new and improved process for separating finely divided insoluble material from a coal liquefaction product.

A further object of the present invention is to provide a process for separating insoluble material from a coal liquefaction product which does not require a filtration step.

These and other objects of the present invention should be more readily apparent from reading the following detailed description thereof with reference to the accompanying drawing wherein:

The drawing is a simplified schematic flow diagram of a coal liquefaction process incorporating the teachings of the present invention.

In accordance with the present invention, a coal liquefaction product comprised of a liquid coal extract of dissolved carbonaceous matter in a liquefaction solvent and insoluble material (ash and unreacted coal) is introduced into an ash separation zone which is operated to recover an essentially solid free stream and a solid containing stream having an ash content of at least about 6%, by weight. The solid containing stream is then stripped of components boiling up to about 900°F. to thereby provide a flowable stripped solid containing stream having a reduced content of liquid combustibles. It has been found that by maximizing the ash content of the net solid containing stream recovered from the ash separation zone while ensuring that the ash content is not so great as to prevent recovery of a flowable stripped solid containing stream, the amount of combustible liquid components present in the stripped solid containing stream can be minimized. In accordance with the present invention, in order to maintain flowable stripped solid containing streams, the stripped solid containing stream, generally contains at least about 35% Benzene solubles. (Benzene solubles is defined as 100 minus Benzene insolubles, with Benzene insolubles as known in the art, being conveniently determined by ASTM O-367-67). As should be apparent, the amount of Benzene solubles present in the stripped solid containing stream is directly proportional to the amount of combustible liquid and, accordingly, the upper limit of Benzene solubles is set by the desired minimization of liquid combustibles in the stripped solid containing stream. In general, the Benzene solubles of the stripped solid containing stream is less than about 70 wt.%, and most generally in the order of 40 to 60 weight percent. It should also be apparent that it would be desirable to reduce the Benzene solubles content to less than 35 weight % in order to minimize the amount of liquid combustibles in the stripped solid containing stream, but the necessity to maintain flowable streams generally precludes a further reduction in Benzene solubles. Thus, in accordance with the present invention, the ash content of the solid containing stream is controlled to provide a stripped solid containing stream in which the Benzene solubles are minimized, but are not less than 35% in order to maintain a flowable stripped solid containing stream.

In general, the ash content of the solid containing stream employed as feed to the stripping zone has an ash content from about 6% to about 18%, preferably from about 8% to about 16%, and most preferably from about 9% to about 13%, all by weight.

The invention will be further described with respect to the preferred embodiment thereof wherein solid material is separated from the coal liquefaction product by gravity settling in conjunction with a promoter liquid, as hereinafter described. The gravity settling zone which is employed to provide a net overflow product essentially free of solid material, and a net solid containing underflow, having an ash content of at least 6%, by weight, may be comprised of one, two or more gravity settlers, as required, to provide the net underflow having the required ash content, with the underflow from one gravity settler being employed as feed to the next gravity settler.

The gravity settling zone, which as hereinabove described may be comprised of one, two or more gravity settlers, is operated in a manner such that settling is effected at a temperature from about 300°F to about 600°F, preferably from about 350°F to 500°F and at a pressure from about 0 psig to about 500 psig., preferably from about 0 psig to about 300 psig. In general, the residence time for the settling is in the order of 0.1 to 8 hours and preferably from 0.2 to 4 hours. In accordance with the preferred embodiment in which two gravity settlers are employed, the second gravity settler is preferably operated at a lower upflow velocity than the first gravity settler; e.g., the second settler is operated at 1/5 to 4/5 of the upflow liquid velocity of the first settler. The specific upflow velocity employed in each of the settlers will, in part be determined by the particle size distribution of solids with the presence of more fine particles requiring lower upflow velocities in order to insure an essentially solid free overflow. In addition, a minor portion of the feed to the first settler is withdrawn as underflow; i.e., less than 50%, generally in the order of 5 to 30 weight percent, and a minor portion of the feed to the second settler is withdrawn as overflow; i.e., less than 50% and generally in the order of 15 to 30 weight percent. It is to be understood that the above conditions are illustrative, and the choice of optimum conditions is within the scope of those skilled in the art from the teachings herein. Thus, for example, higher pressures could be used, but as should be apparent to those skilled in the art, for economic reasons, the lower pressures are preferred.

As hereinabove described, the gravity settling is effected in the presence of a liquid promoter to enhance and promote the separation of insoluble material and provide a liquid overflow essentially free of insoluble material.

The liquid which is employed to enhance and promote the separation of insoluble material from the coal liquefaction product is generally a hydrocarbon liquid having a characterization factor (K) of at least about 9.75 and preferably at least about 11.0 wherein:

$$K = \sqrt[3]{\frac{T_B}{G}}$$

wherein $T_B$ is the molal average boiling point of the liquid (°R); and G is specific gravity of the liquid (60 F/60°F).

The characterization factor is an index of the aromaticity/parafinicity of hydrocarbons and petroleum fractions as disclosed by Watson & Nelson, Ind. Eng. Chem. 25,880 (1933), with more parafinic materials having higher values for the characterization factor (K). The promoter liquid which is employed is one which has a characterization factor (K) in excess of 9.75 and which is also less aromatic than the liquefaction solvent; i.e., the characterization factor K of the promoter liquid has a value which is generally at least 0.25, higher than the characterization factor of the liquefaction solvent.

The following Table provides representative characterization Factors (K) for various materials:

TABLE

| | |
|---|---|
| Anthracene | 8.3 |
| Naphthalene | 8.4 |
| 425–500°F Coal Tar Distillate | 8.8 |
| 550–900°F Coal Tar Distillate | 9.1 |
| 600–900°F Coal Tar Distillate | 9.0 |
| 400–450°F Coal Tar Distillate | 9.4 |
| Benzene | 9.8 |
| Tetrahydronaphthalene | 9.8 |
| o-xylene | 10.3 |
| Decahydronaphthalene | 10.6 |
| Cyclohexane | 11.6 |
| 425–500°F Boiling Range Kerosene | 11.9 |
| n-Dodecylbenzene | 12.0 |
| Propylene Oligomers (pentamer) | 12.2 |
| Cetene | 12.8 |
| Tridecane | 12.8 |
| n-Hexane | 12.9 |
| Hexadecane or cetane | 13.0 |

The liquid which is used to enhance and promote the separation of insoluble material is further characterized by a 5 volume percent distillation temperature of at least about 250°F and a 95 volume percent distillation temperature of at least about 350°F and no greater than about 750°F. The promoter liquid preferably has a 5 volume percent distillation temperature of at least about 310°F and most preferably of at least about 400°F. The 95 volume percent distillation temperature is preferably no greater than about 600°F. The most preferred promoter liquid has a 5 volume percent distillation temperature of no greater than about 500°F. It is to be understood that the promoter liquid may be a hydrocarbon; e.g., tetrahydronaphthalene, in which case the 5 volume percent and 95 volume percent distillation temperatures are the same; i.e., the hydrocarbon has a single boiling point. In such a case, the boiling point of the hydrocarbon must be at least about 350°F in order to meet the requirements of a 5 volume percent distillation temperature of at least about 250°F and a 95 volume percent distillation temperature of at least about 350°F. The promoter liquid is preferably a blend mixture of hydrocarbons in which case the 5 volume percent and 95 volume percent distillation temperatures are not the same.

The 5 volume and 95 volume percent distillation temperature may be conveniently determined by ASTM No. D 86-67 or No. D 1160 with the former being preferred for those liquids having a 95% volume distillation temperature below 600°F and the latter for those above 600°F. The methods for determining such temperatures are well known in the art and further details in this respect are not required for a full understanding of the invention. It is also to be understood that the reported temperatures are corrected to atmospheric pressure.

As representative examples of such liquids, there may be mentioned: kerosene or kerosene fractions from paraffinic or mixed base crude oils; middle distillates, light gas oils and gas oil fractions from paraffinic or mixed based crude oils; alkyl benzenes with side chains containing ten or more carbon atoms; paraffinic hydrocarbons containing more than 12 carbon atoms; white oils or white oil fractions derived from crude oils; alphaolefins containing more than 12 carbon atoms; fully hydrogenated naphthalenes and substituted naphthalenes; propylene oligomers (pentamer and higher); tetrahydronaphthalene, heavy naphtha fractions, etc. The most preferred liquids are kerosene fractions; white oils; fully hydrogenated naphthalenes and substituted naphthalenes; and tetrahydronaphthalene.

The amount of liquid promoter used for enhancing and promoting the separation of insoluble matter from the coal liquefaction product will vary with the particular liquid employed, the coal liquefaction solvent, the coal used as starting material and the manner in which the liquefaction is effected. As should be apparent to those skilled in the art, the amount of liquid promoter used should be minimized in order to reduce the overall costs of the process. It has been found that by using the liquid of controlled aromaticity, in accordance with the teachings of the present invention, the desired separation of insoluble material may be effected with modest amounts of liquid promoter. In general, the weight ratio of liquid promoter to coal solution may range from about 0.2:1 to about 3.0:1, preferably from about 0.3:1 to about 2.0:1 and, most preferably from about 0.3:1 to about 1.5:1. In using the preferred promoter liquid which is kerosene fraction having 5% and 95% volume distillation temperatures of 425°F, and 500°F, respectively, promoter liquid to coal solution weight ratios in the order of 0.4:1 to 0.6:1 have been particularly successful. It is to be understood, however, that greater amounts of liquid promoter may be employed but the use of such greater amounts is uneconomical. In addition, the use of an excess of liquid promoter may result in the precipitation or separation of an excessive amount of desired coal derived products from the coal extract. More particularly, as the amount of liquid promoter employed is increased, a greater amount of ash is separated from the coal solution, but such increased ash separation is accompanied by an increased separation of desired coal derived products from the coal solution. By using the liquid promoters as herein described, not only may modest amounts of solvent be employed, but, in addition, ash may be effectively separated from the coal solution; e.g., in amounts greater than 90%, without an excessive loss of desired coal derived products.

The net underflow recovered from the gravity settling zone, having an ash content of at least 6 wt. %, and generally from 8 wt. % to 16 wt. %, as hereinabove described, is then introduced into an underflow stripping zone to strip valuable products therefrom; i.e., components boiling up to about 900°F. The stripping zone may be comprised of any one or more of a wide variety of stripping apparatus. The stripping is preferably effected in a vacuum flash distillation tower, operated at a temperature from about 500°F to about 900°F, and a pressure from about 10 mm. Hg to about 760 mm Hg. It is to be understood that the above conditions are merely illustrative and do not limit the scope of the invention. The selection of suitable stripping conditions for recovering valuable components from the underflow are within the scope of those skilled in the art.

In a coal liquefaction process, potential clean fuel valuable product loss is measured approximately by the amount of combustibles which are present in stripped underflow, with the combustible matter being comprised of coal derived heavy oil and unreacted coal and/or associated petrographic constituents. The heavy oil content of the stripped underflow, which forms a portion of the combustibles, is conveniently measured by Benzene solubles, as hereinabove defined. In accordance with the present invention, the amount of combustibles present in the stripped solid containing stream (conveniently measured as a combustible to ash ratio) will vary depending upon the solid combustible content (unreacted coal and/or associated petrographic constituents) of the coal used as the original feed. Thus, for example, for a coal with a low ash content and high content of unreactive carbon, the combustible to ash ratio in the stripped underflow may be in the order of 4.0 or 5.0, whereas for a coal with high ash and low unreactive carbon, the combustible to ash weight ratio may be in the order of 2.5 or less. However, by proceeding in accordance with the present invention, the coal derived heavy oil content of the stripped underflow is minimized while maintaining flowable conditions, whereby for a given coal source, the combustible to ash ratio of the stripped underflow is also minimized. As hereinabove noted, the ash content of the underflow fed to the stripping zone is maximized, while maintaining the ash content at a value which permits recovery of a flowable stripped solid containing underflow, whereby a stripped flowable underflow can be recovered having a minimum amount of coal derived heavy oil; i.e., a minimum Benzene soluble content, with the Benzene solubles being at least 35% to provide a flowable stream.

In addition, the net coal product (the extracted carbonaceous matter, excluding promoter liquid, liquefaction solvent and gas make), hereinafter sometimes referred to as "coal product", contains less than about 0.5% insoluble material, all by weight. The specific amount of insoluble material which is permitted to be present in the coal product is dependent upon the product standards, and the deashing is controlled in order to provide the required specifications. Based on an Illinois type coal, the production of a coal product having less than 0.05%, by weight, insoluble material, corresponds to 99.8+% ash removal to provide a coal product having the required minimum amount of insoluble material is dependent upon the initial ash content of the coal. Thus, in accordance with the present invention, the liquid promoter is added to the coal solution in an amount, as hereinabove described, to provide a coal product in which insoluble material is present in an amount of less than about 0.05%, by weight, and to provide a flowable stripped underflow having a minimum Benzene soluble content and which is at least in the order of 35%.

The liquid promoter may also be prepared by blending a material having a characterization factor below 9.75 with a material having a characterization factor above 9.75, provided the blend has a characterization factor above 9.75 and the boiling properties, as hereinabove described. The use of blended materials is a convenient manner of regulating the characterization factor.

The invention will be further described with respect to an embodiment thereof illustrated in the accompanying drawing. It is to be understood however, that the scope of the invention is not to be limited thereby.

Referring to the drawing, ground or pulverized coal, generally bituminous, sub-bituminous or lignite, preferably bituminous coal, in line 10 is introduced into a coal solvation and slurrying zone 11 along with a coal liquefaction solvent in line 12. The coal liquefaction solvent may be any one of the wide variety of coal liquefaction solvents used in the art, including both hydrogen donor solvents, non-hydrogen donor solvents and mixtures thereof. These solvents are well known in the art and, accordingly, no detailed description thereof is deemed necessary or a full understanding of the invention. As particularly described, the coal liquefaction solvent is a 600°F–900°F solvent which is recovered from the coal liquefaction product and which has not been subjected to hydrogenation subsequent to the recovery thereof. The solvent is added to the coal in an amount sufficient to effect the desired liquefaction, and in general, is added in an amount to provide a solvent to coal weight ratio from about 1:1 to about 20:1, and preferably from about 1.5:1 to about 5:1.

A coal paste is withdrawn from zone 11 through line 13 and introduced into a coal liquefaction zone 14 wherein, as known in the art, the coal is converted to liquid products. The liquefaction zone 14 is operated as known in the art and may be catalytic or non-catalytic amd may be effected in the presence or absence of added hydrogen. The hydrogenation may be effected in a fixed catalyst bed, fluidized catalyst bed or in an expanded or ebullating bed. The details of the coal liquefaction step form no part of the present invention, and accordingly, no details thereof are required for a full understanding of the invention. As particularly described, the coal liquefaction is effected in the presence of added hydrogen. The hydrogenation as known in the art, increases the recovery of coal products and also reduces the sulfur and nitrogen content of the recovered liquid coal product. The liquefaction is preferably effected in an upflow ebullating bed, as known in the art; e.g., as described in U.S. Pat. No. 2,987,465 to Johanson. The coal liquefaction zone, as known in the art, includes means for recovering the various gaseous products.

A coal liquefaction product, comprised of a liquid coal extract of dissolved carbonaceous matter in the coal liquefaction solvent and insoluble material (ash and undissolved coal) is withdrawn from the liquefaction zone 14 through line 15 and introduced into a separation zone 16 to separate from the coal liquefaction product at least those material boiling up to about the 95 volume percent distillation temperature of the liquid to be used for promoting and enhancing the separation of the insoluble material. The separation zone 16 may include an atmospheric or vacuum flashing chamber or tower, and as particularly described separation zone 16 is designed and operated to separate components boiling up to about 600°F.

A coal liquefaction product, free of components boiling up to about 600°F withdrawn from separation zone 16 through line 17, is mixed with promoter liquid in line 21 of controlled aromaticity, i.e., the characterization factor of the promoter liquid has a value which is generally at least 0.25 units greater than the characterization factor of the coal liquefaction solvent. As particularly described, the promoter liquid is a kerosene fraction which has a 5 volume percent and 95 volume percent distillation temperatures which fall within the range fom about 415°–500°F and is derived from a naphthenic or paraffinic distillate.

The combined stream of coal liquefaction product and promoter liquid in line 22 is introduced into a gravity settling zone, generally designated as 23, and as particularly shown the gravity settling zone 23 includes gravity settlers 24 and 25. The gravity settlers 24 and 25 are operated as hereinabove described to produce a net underflow from settler 25 having an ash content of at least about 6%, with the underflow form gravity settler 24 being employed as feed to gravity settler 25.

Essentially solid free overflows are recovered from gravity settlers 24 and 25 through lines 26 and 27, respectively, and the combined overflow in line 28 is introduced into a recovery zone 29 for recovering promoter liquid and various fractions of the coal extract.

The recovery zone 29 may be comprised of one or more fractionators to distill various fractions from the product. As particularly described, the recovery zone is operated to recover a first fraction having 5% and 95% volume distillation temperature of from 425° to 500°F. which is to be used as the promoter liquid for enhancing and promoting separation of solid material from the coal liquefaction product; a second fraction (600°–900°F) a portion of which may be used as the coal liquefaction solvent in line 12 and a further portion thereof recovered as product, and a residual product (+900°F) of low ash and reduced sulfur content. The promoter liquid recovered in the recovery zone is admixed with the liquefaction product in line 17 and makeup may be provided through line 41.

The net underflow containing dispersed insoluble material (having an ash content of at least about 6%) withdrawn from gravity separation zone 25 through line 51 is introduced into a stripping zone 52 wherein material boiling, below about 900°F is stripped therefrom and introduced into the recovery zone 29 through line 53. As hereinabove described, the stripper bottoms in line 54, has a minimum amount of Benzene solubles, with the Benzene solubles being at least about 35% to maintain flowable streams. The bottoms in line 54 may then be subjected to calcination or coking. Alternatively, part of the stripper bottoms may be used as feedstock to a partial oxidation process for producing hydrogen. As a further alternative, a portion of the stripper bottoms may be used for plant fuel. These uses and others should be apparent to those skilled in the art from the teachings herein. In accordance with the present invention, the coal product (the product recovered from zones 16 and 29, excluding liquefaction solvent and promoter liquid) contains less than 0.05%, by weight, of insoluble material.

Although the invention has been particularly described with respect to the preferred embodiment wherein solid material is separated by gravity settling in the presence of a promoter liquid, the overall teachings of the invention are also applicable to other separation techniques such as centrifugation and separation by use of a hydrocyclone.

The invention will be further described with respect to the following example, but the scope of the invention is not to be limited thereby.

EXAMPLE 1

A coal paste consisting of 40 wt.% Illinois coal and 60 wt.% 600°–900°F boiling range coal tar distillate paste oil is admixed with hydrogen and is continuously fed through a preheater into the bottom of a 1 inch upflow expanded bed reactor operating at the conditions summarized below in Table 1. The temperature of the hydrogen/coal paste admixture is increased to about 675°F. in the preheater.

TABLE I

| Catalyst | Cobalt Molybdate on Alumina Spheres (8–12 mesh) |
|---|---|
| Mode of Contact | Upflow Expanded Bed |
| Coal Paste Feed Rate, gals/hr at 150°F. | 3.0 |
| Total Gas Feed Rate, SCF/hr. | 300 |
| Liquid Hourly Space Velocity at 150°F, $hr^{-1}$ | 1.5 |
| Operating Pressure (total), psig | 1400 |
| Hydrogen Partial Pressure at Reactor Outlet, psia | 1200 |
| Operating Temperature, °F | 800±30 |

Ash containing reactor effluent product is cooled to 300°F and collected in one of two interchangeable high pressure gas/liquid separators piped in parallel. When separator number 1 is about 80% filled with liquid product, separator 2 is placed on line and the contents of separator 1 are transferred to a low pressure liquid product receiver. The liquid contents of the low pressure receiver are pumped to a steam jacketed blend tank.

EXAMPLE 2

After blending the ash containing coal solution prepared in Example 1 it is pumped through an electrically heated coil and into a continuous equilibrium flash unit. The flash chamber was operated at 600°±10°F.

and atmospheric pressure. A feed rate of about 5 gals. per hour and and a supplemental nitrogen sparge rate of 75 SCF/hr were employed. Overhead vapors from the flash chamber were condensed and collected in 55 gallon drums, and residual product was collected in a receiver from which it was pumped to a 500 gal. steam jacket blend tank. After blending, the composite residual product contained about 4.4 wt.% ash, had an initial boiling point of about 580°F., and about 25 wt.% of the solution had a boiling point in excess of 900°F corrected to 760 mm Hg abs. pressure.

EXAMPLE 3

1200 gms of residual product prepared in example 2 are charged to a clean electrically heated 2-liter stainless steel shaker bomb. The contents of the shaker bomb are heated with shaking to 400°F. 60 gms of 425°–500°F boiling range kerosene distillate having a characterization factor of 11.9 are added to the shaker bomb and the temperature of the admixture is increased to 500°±10°F. with shaking. The bomb is placed in a vertical position and the contents allowed to settle for 4 hours at 400°F. 385 gms of ash rich underflow are withdrawn through a hot water traced bottom valve and then the balance of an ash lean overflow stream is collected in a separate container. The ash content of the underflow and overflow streams was determined and the analytical data is compiled in Table 2. A sample of the ash containing underflow stream was vacuum stripped in the laboratory until an overhead cutpoint of 880°–900°F corrected to atmosphereic pressure was reached. The vacuum in the distillation flask was broken with nitrogen and the residue remaining was removed. This vacuum residue which will hereafter be referred to as "stripped underflow" was analyzed for fluidity at 550°F in a nitrogen swept Brookfield viscosimeter. Aliquot samples of stripped underflow were also analyzed for benzene insolubles content and ash contents. Experimental and analytical data acquired in example 3 are summarized in Table 2.

EXAMPLE 4

Identical to example 3 except that 490 gms instead of 385 gms of ash rich underflow are withdrawn from the shaker bomb. Process and analytical data are summarized in Table 2.

EXAMPLE 5

Identical to example 3 except that 650 gms instead of 385 gms of ash rich underflow are withdrawn from the shaker bomb. Process and analytical data are summarized in Table 2.

EXAMPLE 6

Identical to example 3 except that 730 gms instead of 385 gms of ash rich underflow are withdrawn from the shaker bomb. Process and analytical data are summarized in Table 2.

TABLE 2

EXPERIMENTAL DATA ACQUIRED FOR THE BENCH SCALE DEASHING OF A COAL SOLUTION PREPARED IN EXAMPLE 1 and 2

| Exp. Number | 3 | 4 | 5 | 6 |
|---|---|---|---|---|
| Wt of Underflow Withdrawn, gms | 385 | 490 | 650 | 730 |
| Percent Underflow Withdrawn, wt.% of total | 21.39 | 27.22 | 36.11 | 40.56 |
| Ash Content of Underflow, wt.% | 13.64 | 10.84 | 8.04 | 7.15 |
| Ash Content of Overflow, wt.% | .01 | <.01 | <.01 | <.01 |
| Stripped Underflow Analytical Data | | | | |
| Ash Content (A), wt.% | 38.62 | 31.61 | 29.62 | 28.17 |
| Benzene (B.I.), wt.% | 67.4 | 56.1 | 54.1 | 53.6 |
| Fluidity Detm. on Brookfield Viscosimeter at 550°F. | not fluid | fluid | → | → |
| Benzene Solubles (B.S.) [(B.S.)=100−(B.I.)], wt. % | 32.6 | 43.9 | 45.9 | 46.4 |
| Combustibles /Ash Wt. Ratio ($\alpha$) $\alpha = \frac{100-(A)}{A}$, unitless | 1.59 | 2.16 | 2.33 | 2.55 |

The above examples 3 and 6 indicate that by increasing the ash content of the underflow, employed as feed to the stripper, the combustible to ash weight ratio in stripped underflow can be decreased.

The following example 7 illustrates the effect of two stage settling to increase the ash content of the feed to the stripping operation to thereby reduce the combustible to ash weight ratio in the stripped underflow.

EXAMPLE 7

350 gms of ash rich underflow prepared in example 6 were charged to an electrically heated 500 cc stainless steel bomb outfitted with an internal thermocouple, bottom draw-off valve and two side draw-off connections. All draw-off connections were traced with hot water. The contents of the bomb were heated to 500°±10°F and allowed to settle for 3 hours at 500°±10°F. The top side draw-off connection was opened and 100 gms of a secondary ash lean overflow stream were withdrawn. The balance or an ash enriched secondary underflow stream was withdrawn through the bottom outlet valve.

The ash contents of the secondary overflow and underflow streams, generated in this example were found to be 0.01 wt.% and 10.0 wt.%, respectively. The balance of the secondary underflow was vacuum stripped in the laboratory to a cutpoint of about 880°F. corrected to an absolute pressure of 760 Hg abs. This distillation residue was analyzed for 550°F fluidity in a nitrogen swept Brookfield viscosimeter. In addition ash content and Benzene insolubles content were determined on the distillation residue. The distillation residue or secondary stripped underflow had an ash content of 30.6 wt.%, a benzene insolubles content of 55.4 wt.% and was fluid at 550°F. Alternatively, the benzene solubles (B.S.) was 44.6wt% and the combustibles to ash wt. ratio of the stripped secondary underflow was 2.27.

Thus, by increasing the ash content of the underflow to the stripper from about 7% (example 6) to about 10% (example 7) the combustible to ash weight ratio in the stripped underflow is decreased from 2.55 (example 6) to 2.27 (example 7).

The present invention is particularly advantageous in that insoluble materials can be separated from a coal liquefaction product without requiring filtration. In addition, insoluble material separation is maximized while minimizing loss of potentially valuable product.

Numerous modifications and variation of the present invention are possible in light of the above teachings and, therefore, within the scope of the appended claims the invention may be practised otherwise than as particularly described.

What is claimed:

1. In a process for separating insoluble material from a coal liquefaction product produced from a coal feed and comprised of insoluble material, including coal ash and carbonaceous matter dissolved in a coal liquefaction solvent, comprising:

separating from the coal liquefaction product an essentially solid free stream and a flowable solid containing stream, containing coal derived liquid product and insoluble material, including coal ash, said separation being effected to provide a flowable solid containing stream having an ash content of from 6% to 18%, by weight, and which produces a stripped solid containing stream having Benzene solubles of at least 35 wt. %; and stripping from said solid containing liquid stream components, including coal derived liquid components, boiling up to about 900°F to produce a stripped solid containing stream having coal derived liquid product and Benzene solubles of at least about 35 wt.%.

2. The process of claim 1 wherein the ash content of said solid containing liquid stream is from about 8% to about 16%, by weight.

3. The process of claim 2 wherein the ash content of said solid containing liquid stream is from 9% to about 13%.

4. The process of claim 2 wherein the stripped solid containing stream has Benzene solubles of about 40 to about 60 weight percent.

5. A process for separating insoluble material from a coal liquefaction product produced from a coal feed and comprised of insoluble material, including coal ash and carbonaceous matter dissolved in a coal liquefaction solvent, comprising:

introducing the coal liquefaction product and a liquid promoter into a gravity settling zone, said promoter liquid having a 5 volume percent distillation temperature of at least about 250°F and a 95 volume percent distillation temperature of at least about 350°F and no greater than about 750°F, said promoter liquid having a characterization factor (K) of at least 9.75 wherein:

$$K = \sqrt[3]{\frac{T_B}{G}}$$

wherein $T_B$ is molal average boiling point °R and G is specific gravity (60°F/60°F), said promoter liquid having a characterization factor greater than said coal liquefaction solvent and added in an amount sufficient to produce an overflow essentially free of insoluble material;

recovering from said gravity settling zone a net overflow essentially free of insoluble material and a flowable solid containing net underflow, containing coal derived liquid product and insoluble material, including ash, said net underflow having an ash content of from 6 wt.% to 18 wt.% and which produces a stripped net underflow having Benzene solubles of at least 35 wt. %;

stripping said net underflow to recover components boiling up to about 900°F;

and recovering a stripped net underflow having coal derived liquid product and insoluble material, with Benzene solubles of at least 35 wt.%.

6. The process of claim 5 wherein the ash content of said solid containing net underflow stream is from about 8% to about 16%, by weight.

7. The process of claim 6 wherein the ash content of said solid containing net underflow stream is from 9% to about 13%.

8. The process of claim 6 wherein the stripped net underflow has Benzene solubles of from about 40% to about 60%, by weight.

9. The process of claim 6 wherein said gravity settling zone is comprised of two gravity settlers, with the net underflow being recovered from the second gravity settler and underflow from the first gravity settler being employed as feed to the second gravity settler.

10. The process of claim 6 wherein the liquid promoter has a characterization factor of at least about 11.0.

11. The proces of claim 10 wherein the promoter liquid is a fraction having a 5 volume percent distillation temperature of at least about 425°F and a 95 volume percent distillation temperature of no greater than 500°F.

12. The process of claim 10 wherein said gravity settling is effected at a temperature from about 300°F to about 600°F and a pressure from about 0 psig to about 500 psig.

13. The process of claim 10 wherein the promoter liquid is a kerosene fraction having a characterization factor of about 11.9.

* * * * *